United States Patent [19]

Leutwyler et al.

[11] Patent Number: 4,969,298

[45] Date of Patent: Nov. 13, 1990

[54] APPARATUS FOR CLAMPING BAR-SHAPED CUTTERS AT A GRINDING MACHINE

[75] Inventors: Robert Leutwyler, Boppelsen; Georg Mächler, Dällikon, both of Switzerland

[73] Assignee: Werkzeugmaschinenfabrik Oerlikon-Buhrle Ag, Zurich, Switzerland

[21] Appl. No.: 422,230

[22] Filed: Oct. 16, 1989

[30] Foreign Application Priority Data

Nov. 11, 1988 [CH] Switzerland ..... 04187/88

[51] Int. Cl.[5] ..... B24B 19/00; B25B 5/16

[52] U.S. Cl. ..... 51/218 R; 269/275; 269/254 R; 51/217 R

[58] Field of Search ..... 51/217 R, 218 R, 254 R; 269/24, 25, 27, 32, 34, 265, 254 R, 266, 275

[56] References Cited

U.S. PATENT DOCUMENTS

| | | | |
|---|---|---|---|
| 2,447,236 | 8/1948 | Dery | 269/275 |
| 3,020,041 | 2/1962 | Peterson et al. | 269/275 |
| 3,561,748 | 2/1971 | Schefers | 269/275 |
| 3,951,395 | 4/1976 | Hennenfent et al. | 269/266 |
| 4,095,376 | 6/1978 | Lotane | 51/218 R |
| 4,261,558 | 4/1981 | Carossino | 269/275 X |
| 4,294,444 | 10/1981 | Horton | 269/32 X |
| 4,538,797 | 9/1985 | Lerch | 269/27 |

FOREIGN PATENT DOCUMENTS

| | | |
|---|---|---|
| 0201861 | 10/1907 | Fed. Rep. of Germany . |
| 2586955 | 6/1978 | France . |

*Primary Examiner*—Frederick R. Schmidt
*Assistant Examiner*—Bruce P. Watson
*Attorney, Agent, or Firm*—Sandler, Greenblum & Bernstein

[57] ABSTRACT

In order that bar-shaped cutters can be ground as accurately as possible, it is essential that the bar-shaped cutters are clamped as close as possible to the surfaces which are to be ground. For this purpose, each bar-shaped cutter is pressed against two stop faces or surfaces by means of two claws of a clamping lever, and the one claw which is closer to the surface to be ground is structured to be more elastic or resilient than the other claw. Particularly, the claw closer to the surface which is to be ground is more intensely pressed or forced against the bar-shaped cutter than the other claw.

5 Claims, 2 Drawing Sheets

APPARATUS FOR CLAMPING BAR-SHAPED CUTTERS AT A GRINDING MACHINE

BACKGROUND OF THE INVENTION

The present invention broadly relates to clamping or chucking apparatus or equipment and, more specifically, pertains to a new and improved apparatus for clamping bar-shaped cutters at a grinding machine, in which clamping apparatus the bar-shaped cutters are hydraulically clamped.

Generally speaking, the clamping apparatus of the present development is of the type comprising a rotary table or turntable at which the bar-shaped cutter is pressed or forced against two stop faces or surfaces of the rotary table or turntable by means of a pivotable clamping lever. The clamping apparatus also comprises a hydraulic cylinder for actuating the pivotable clamping lever.

If such bar-shaped cutters are mounted at or inserted in the cutter head of a gear-cutting machine for spiral-toothed bevel gears, it is imperative that these bar-shaped cutters geometrically and dimensionally correspond with one another as accurately as possible. For this purpose, such bar-shaped cutters, which belong to the same cutter head, were hitherto jointly ground. However, it is now evident that in this manner the required consistency or conformity of the cutters of a selected batch or set of cutters for a cutter head is not really achieved. Therefore, further measures are required in order to grind the bar-shaped cutters with the requisite accuracy.

SUMMARY OF THE INVENTION

Therefore, with the foregoing in mind, it is a primary object of the present invention to provide a new and improved construction of apparatus for clamping bar-shaped cutters at a grinding machine in a manner not afflicted with the aforementioned drawbacks and limitations of the prior art constructions.

Another and more specific object of the present invention aims at providing a new and improved construction of clamping or chucking apparatus for clamping bar-shaped cutters for a gear-cutting machine at a grinding machine, which clamping or chucking apparatus renders possible that bar-shaped cutters can be ground substantially more accurately than hitherto possible.

Yet a further important object of the present invention is to provide a new and improved construction of apparatus for clamping bar-shaped cutters, which apparatus is relatively simple in construction and design, economical to manufacture, reliable in operation, possesses compact external dimensions and, for the purpose of clamping the cutters, requires a very small amount of freedom of movement space.

Now in order to implement these and still further objects of the invention, which will become more readily apparent as the description proceeds, the apparatus for clamping bar-shaped cutters at a grinding machine is manifested, among other things, by the features that each pivotable clamping lever is provided with two claws and that the bar-shaped cutter is pressed or forced against the two stop faces or surfaces by means of these two claws, and the one claw is structured to be more elastic or resilient or flexible than the other claw.

It is advantageous when the one claw is substantially longer than the other claw and, by virtue of the unequal claw length, possesses a correspondingly greater spring rate or reaction than the other claw.

Additionally, the longer claw is advantageously located closer to the cutter surfaces which are to be ground than the other or shorter claw.

A further advantage worthy of mention resides in the fact that the longer claw comprises a substantially smaller cross-section than the other or shorter claw.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures of the drawings, there have been generally used the same reference characters to denote the same or analogous components and wherein.

DETAILED DESCRIPTION OF THE PREFERRED EMBODIMENTS

Figure 1:
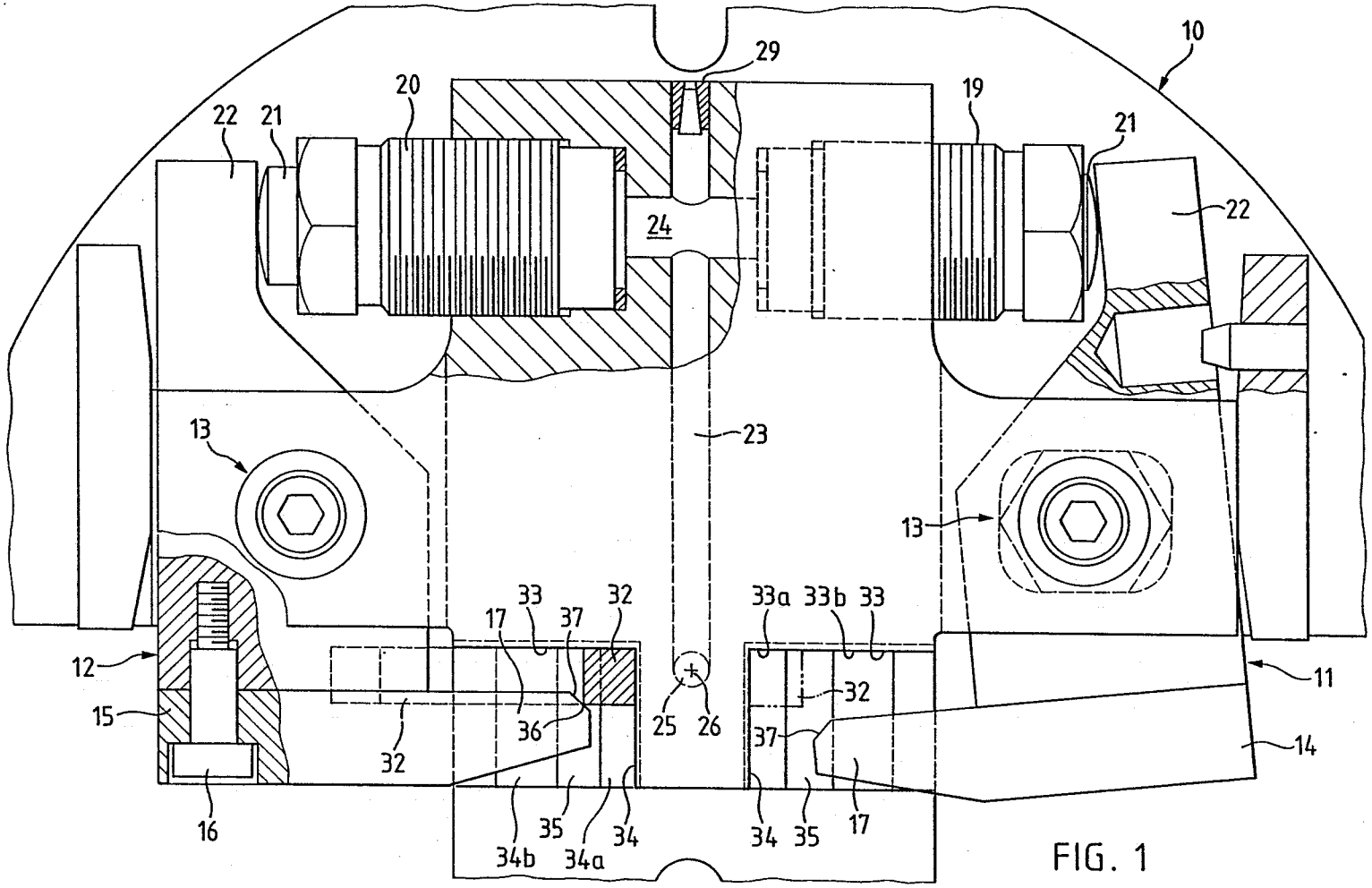
FIG. 1 is a top plan view, partially in section, of a rotary table or turntable provided with a clamping apparatus constructed according to the invention.
Figure 2:
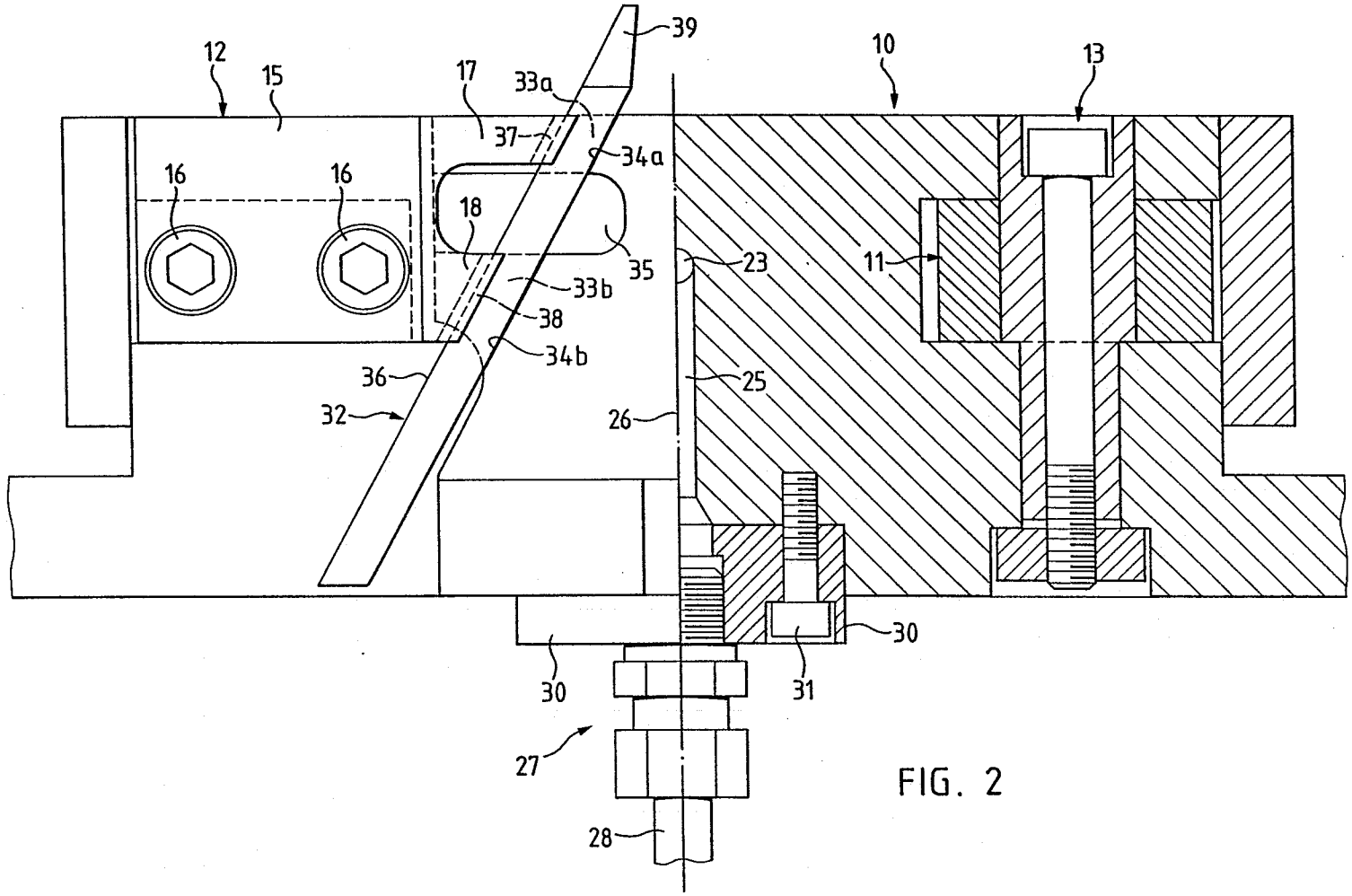
FIG. 2 is a front view, partially in section, of the inventive clamping apparatus depicted in FIG. 1.

Describing now the drawings, it is to be understood that to simplify the showing thereof, only enough of the apparatus for clamping bar-shaped cutters at a grinding machine has been illustrated therein as is needed to enable one skilled in the art to readily understand the underlying principles and concepts of the present invention. Turning attention now to the drawings, FIGS. 1 and 2 show a rotary table or turntable 10 at which two clamping levers 11 and 12 are rotatably mounted for rotary or pivotal motion about respective pivot axes 13. At the lower or front end of these pivotable clamping levers 11 and 12, respective attachments or adjoint pieces 14 and 15 are mounted by means of screws or bolts 16 or equivalent fixation facility.

These attachments or adjoint pieces 14 and 15 each comprise two claws or claw members 17 and 18, as shown in FIG. 2. The top or upper claw 17 is substantially longer than the bottom or lower claw 18. Furthermore, the longer top or upper claw 17 possesses a smaller cross-section than the shorter bottom or lower claw 18. Two cylinders 19 and 20 are screwed or threadably attached to the rotary table or turntable 10 for actuating the two pivotable clamping levers 11 and 12, respectively. In these two cylinders 19 and 20 there are displaceably mounted respective pistons 21, which bear upon the upper or rear ends 22 of the two pivotable clamping levers 11 and 12, respectively. A common hydraulic line or conduit 23 is connected with the cylinders 19 and 20 by means of a branching or split conduit 24. This common hydraulic line or conduit 23 leads to a bore or conduit 25 of the rotary table or turntable 10, which bore or conduit 25 is coaxially arranged to the rotational axis 26 of the rotary table or turntable 10. To this bore or conduit 25 there is conveniently connected a pressure line or conduit 28 by means of a conventional connection 27. The common hydraulic line or conduit 23 is closed by means of a plug or stopper 29.

At the bottom or lower side of the rotary table or turntable 10 there is inserted a centering ring 30 which is fastened to the latter by means of screws or bolts 31 or equivalent fixation facility. The aforesaid conventional connection 27 is secured at this centering ring 30 which serves to center the rotary table or turntable 10.

In order to accommodate or receive bar-shaped cutters 32 which are to be ground, there are provided at the rotary table or turntable 10 stops or stop faces or surfaces 33 and 34 which are oriented substantially at right angles to one another. According to FIG. 2, these two stops or stop faces or surfaces 33 and 34 are subdivided by a recess or opening 35 into two stop surfaces 33*a* and 33*b* and two stop surfaces 34*a* and 34*b*.

The two claws 17 and 18 contact the respective bar-shaped cutter 32 along an edge 36 by means of claw surfaces 37 and 38, respectively, as depicted in FIG. 2. These claw surfaces 37 and 38 are preferably inclined at an angle of approximately 45° with respect to the stop surfaces 33*a* and 33*b* and the stop surfaces 34*a* and 34*b* of the rotary table or turntable 10. Therefore, the longer top or upper claw 17 and the shorter bottom or lower claw 18 press with their claw surfaces 37 and 38 the respective bar-shaped cutter 32 against the stop surfaces 33*a* and 33*b* as well as the stop surfaces 34*a* and 34*b*.

In the exemplary embodiment of the clamping or chucking apparatus constructed according to the invention, the two claws 17 and 18 of the pivotable clamping lever 12, depicted in FIG. 2, are structured and dimensioned such that, upon clamping the bar-shaped cutter 32 at the rotary table or turntable 10, first of all the longer top or upper claw 17 with the claw surface 37 thereof abuts against the edge 36 of the bar-shaped cutter 32, and only subsequent thereto the shorter bottom or lower claw 18 with its claw surface 38 is pressed or forced against the edge 36 of the bar-shaped cutter 32.

Since the top or upper claw 17 is somewhat longer than the bottom or lower claw 18 and, furthermore, comprises a somewhat smaller cross-section, the top or upper claw 17 possesses a correspondingly greater spring rate or reaction than the bottom or lower claw 18. By virtue of the special construction of the two claws 17 and 18, it is rendered possible that the bar-shaped cutters 32 are more intensively pressed against the stop surfaces 33*a*, 33*b* and 34*a*, 34*b* in the area of the cutter surfaces 39 which are to be ground. In this manner, the bar-shaped cutters 32 are reliably and appropriately retained or held during the grinding process in the area or region of the cutter surfaces 39 which are to be ground.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for clamping bar-shaped cutters at a grinding machine, in which apparatus the bar-shaped cutters are hydraulically clamped, comprising:

a rotary table containing stop faces;

pivotable clamping levers;

each bar-shaped cutter at said rotary table being pressed against two associated stop faces by an associated pivotable clamping lever;

hydraulic cylinders for actuating respective ones of said pivotable clamping levers;

said pivotable clamping levers each comprising two claws;

said two claws of each pivotable clamping lever serving to press an associated bar-shaped cutter against two respective stop surfaces of said two associated stop faces of said rotary table;

one of said two claws of each pivotable clamping lever being structured to be more resilient than the other one of said two claws;

each bar-shaped cutter possessing surfaces to be ground; and said one more resilient claw of said two claws being located closer to said surfaces to be ground of the associated bar-shaped cutter than said other one of said two claws.

2. The apparatus as defined in claim 1, wherein:

said one of said two claws of each pivotable clamping lever is structured to be longer than the other one of said two claws and possesses by virtue of its greater length a greater spring stroke than said other one of said two claws; and said longer claw of said two claws, prior to contacting the associated bar-shaped cutter, extending closer to the latter than said other one of said two claws.

3. The apparatus as defined in claim 2, wherein:

said longer claw of said two claws possesses a smaller cross-section than said other one of said two claws.

4. The apparatus as defined in claim 1, wherein:

said two associated stop faces of said rotary table constitute two adjoining stop faces extending at right angles with respect to each other;

said two stop faces engaging the bar-shaped cutter in its clamped position at two surfaces defining a proximal edge of said bar-shaped cutter; and said two claws of each said clamping lever engaging the bar-shaped cutter in its clamped position at a distal edge of said bar-shaped cutter in order to press said two surfaces of said bar-shaped cutter against said two adjoining stop faces of said rotary table.

5. The apparatus as defined in claim 4, wherein:

said two claws of each said clamping member containing respective claw surfaces for engaging said distal edge of said bar-shaped cutter; and said claw surface of each one of said claws extending at an angle of approximately 45° with respect to said two adjoining stop faces of said rotary table.

* * * * *